United States Patent [19]

Simon

[11] 4,301,672

[45] Nov. 24, 1981

[54] PROCESS FOR FORMING SEMI-FLOAT AXLE TUBES AND THE LIKE

[76] Inventor: Joseph A. Simon, 237 Lothrop, Grosse Pointe Farms, Mich. 48236

[21] Appl. No.: 87,742

[22] Filed: Oct. 24, 1979

[51] Int. Cl.[3] ..... B21C 37/16

[52] U.S. Cl. ..... 72/370; 72/266; 72/260

[58] Field of Search ..... 72/266, 265, 260, 267, 72/273, 256, 370, 377; 207/6.1, 10.5

[56] References Cited

U.S. PATENT DOCUMENTS

| | | | |
|---|---|---|---|
| 2,679,681 | 6/1954 | Resler | 72/370 |
| 3,837,205 | 9/1974 | Simon | 72/260 |
| 3,886,649 | 6/1975 | Simon | 228/112 |
| 3,948,073 | 4/1976 | Lovell | 72/266 |
| 4,166,373 | 9/1979 | Braun | 72/356 |

FOREIGN PATENT DOCUMENTS

| | | | |
|---|---|---|---|
| 662352 | 4/1963 | Canada | 72/260 |
| 129857 | 4/1902 | Fed. Rep. of Germany | 72/266 |
| 2100600 | 9/1971 | Fed. Rep. of Germany | 72/266 |

*Primary Examiner*—Roscoe V. Parker

*Attorney, Agent, or Firm*—Cullen, Sloman, Cantor, Grauer, Scott & Rutherford

[57] ABSTRACT

A process for cold forming semi-float axle tubes and similar types of metal tubes which includes arranging a short, tubular blank within an open ended die having an extrusion die throat, and pushing the blank through the die throat with a punch. The punch is provided with a ram portion, for applying pressure to the blank for moving it axially, and also an extension formed in several sections of successively smaller diameter which act as mandrels for sizing the tube interior walls. As the punch pushes the tube axially through the throat, initially a middle size extension is arranged within the throat to extrude a thickened leading edge portion on the blank. Further movement of the die results in a larger extension section traveling through the throat for extruding a thin wall tubular section of considerable length, leaving a small unextruded portion of the blank still within the die. At that point, the punch is removed and a second blank is inserted within the die. The punch is repositioned and presses the second blank against the unextruded portion of the first blank for continuing the extrusion thereof. Because of the spacing provided by the second blank, a smaller, end extension section is positioned within the throat for a short time for extruding a substantially enlarged inwardly extending ring portion on the partially extruded blank, followed by a thickened trailing end portion formed by the middle sized extension traveling through the die throat. While the trailing end thickened portion of the blank is formed, simultaneously the lead thickened end portion of the second blank is also formed. The cycle is repeated with successive blanks. The inwardly thickened lead end portion of each extruded tube is flared or flowed outwardly later, to form a generally bell-like enlarged end portion which is integral with the remainder of the tube, and of a wall thickness corresponding to the thickness of the trailing end thickened portion.

1 Claim, 13 Drawing Figures

PROCESS FOR FORMING SEMI-FLOAT AXLE TUBES AND THE LIKE

BACKGROUND OF INVENTION

The process of this invention relates to forming an integral or one-piece tube having thickened end portions and an intermediate thin wall with one of the end portions of a greater O.D. diameter than the remainder of the tube so that the tube may function as a semi-float truck axle tube or a similar shaped device. The process is somewhat similar to, but an improvement relative to, the cold forming or extrusion process for forming tube enlargements disclosed in my prior U.S. Pat. No. 3,837,205 issued Sept. 24, 1974 and U.S. Pat. No. 3,886,649 issued June 3, 1975.

Tubes of the general shape contemplated herein, are commonly used for what are called semi-float truck axles. This is a long uniform O.D. tube of thin wall section having a thickened wall end section and a thickened wall, bell-shape expanded opposite end section which receives bearings, shaft inserts and the like. Such tubes have in the past been made of multiple sections which have been fastened together as by welding. These sections typically have been formed by forging processes or by machining processes or in separate sections by cold forming processes such as is described above in connection with my prior patents. However, in these types of tubes, it was necessary to form the cross-sectional wall thicknesses greater than required merely for strength purposes, because there have not been feasible ways of easily thinning out the tube areas where strength is not required. In addition, the expenses of making and assembling several sections have been considerable. Thus, the process herein contemplates producing a one-piece, generally thin wall elongated tube of uniform O.D. but with varying I.D.'s at one end and a flared or bell-formed opposite end. By this process, the tube is made in a simple, continuous and relatively inexpensive operation and is of lighter weight, as compared to tubes of prior processes.

SUMMARY OF INVENTION

The process herein involves cold forming or extruding a tubular blank within an open ended die, having a die throat, using a ram type of punch which has a mandrel-like extension fitted within the blank and the die throat. The mandrel extension is formed with multiple steps or sections of successively decreasing diameter so that as the ram punch pushes the blank through the die throat, different diameter mandrel-like sections of the extension fit within the die throat. This results in the production of different wall thicknesses during the cold forming or extrusion of the blank into a finished tube.

By utilizing appropriately sized extension sections, plus adding another blank to the die during the process to act as a spacer for the punch, the tube may be formed with inwardly thickened lead and trailing ends and in addition one or more inwardly extended ring-like formations near an end. To this point, the method described is also disclosed in my co-pending application, Ser. No. 087,717, filed Oct. 24, 1979.

The invention herein contemplates an additional step of inserting a bullet-like shaped ram into an inwardly thickened end portion of the extruded tube to expand it outwardly so that the thickening is outwards or reversely positioned relative to the initial inward thickening. This forms a relatively uniform diameter bell-like expanded end integral with a uniform O.D. tube having inward ring-like formations and an opposite end wall internal thickening.

The tube is typically formed of a suitable steel material selected for appropriate strength. The process of forming the tube is performed cold, that is, at room temperature. Although the blank may be coated with a phosphate coating for lubricating its surface, it is essentially cold and unaltered from a starting rough tube which is cut to the appropriate length.

In this sort of process, there is a tendancy for the metal to heat due to the extrusion process itself, but the heat is relatively low, such as up to around 300 F. The developed temperature is well below the transition temperature of the metal. Thus, the process results in a good metallurgical structure for the purpose intended and produces a relatively thin wall, light weight, integral tube which eliminates the welding and separate assembly operations previously required to produce this type of tube by conventional methods described above.

A principal object of this invention is to produce a lighter weight tube by a single extrusion operation, which is relatively inexpensive and produces a tube construction with reinforced or thicker wall integral sections as required, and with an enlarged thicker wall end portion.

These and other objects and advantages of this invention will become apparent upon reading the following description, of which the attached drawings form a part.

DETAILED DESCRIPTION

Figure 13:
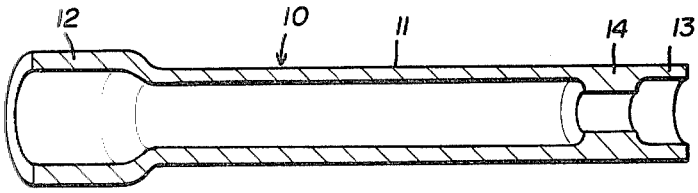
FIG. 13 is a cross-sectional, perspective view showing the complete axle tube.

FIG. 13 illustrates, in perspective, a cross-sectional view of a semi-float axle tube 10 formed by the process of this invention. The tube, which is made of a suitable pre-selected steel or the like, comprises a thin wall tubular middle portion 11, and an enlarged diameter, thicker wall section, end portion 12 and an opposite thickened end portion 13, which is inwardly thickened. The wall thickness of the sections 12 and 13 are the same. In addition, the tube includes an inwardly extending annular ring-like formation 14 adjacent the thickened end 13.

The enlarged portion 12 may be suitably machined, that is, its inner wall surface may be prepared to receive bearings or inserts. Likewise, the inner wall surfaces of the end portion 13, as well as the ring-like formation 14 may be machined, if desired, to receive bearings, inserts or the like.

Significantly, the entire tube is made of a one-piece, cold formed extrusion of sections or portions having a uniform O.D. up to the enlarged end portion 12, and sections of different wall thicknesses. The wall thicknesses are predetermined for either providing enough stock for machining purposes or for increasing strengths or rigidity of those portions, etc.

The method for forming the tube 10 begins with the use of a tubular shaped die 15 which is open ended. The die may be either vertically arranged, as in FIG. 1, or horizontally arranged, i.e., with the horizontal axis, depending upon the type of press equipment used. The die 15 is mounted upon the press bed of a conventional press which is not shown herein as it forms no part of the invention.

Figure 1:
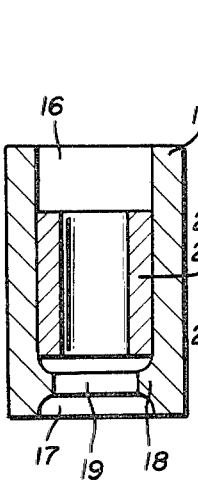
FIG. 1 is a schematic, cross-sectional elevational view of the die within which a blank has been inserted.

The die includes an inlet end 16, an outlet end 17, and an annular shoulder or restriction 18 which forms a narrowed die throat 19. A metal blank 20 is inserted through the inlet end 16 of the die, as illustrated in FIG. 1. The interior diameter of the blank is less than the diameter of the throat 19.

Figure 2:
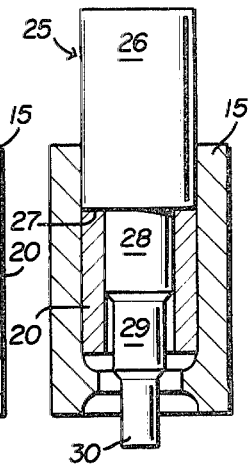
FIGS. 2 through 9, inclusive, show successive steps in forming the blank into a cold formed or extruded tube.

After the blank 20 is positioned within the die, as illustrated in FIG. 2, a punch 25 is inserted within the die. The punch includes a ram portion 26 which is connected to the press ram or platen so that the ram portion 26 may move axially of the die and inwardly toward the die throat.

The bottom surface of the ram portion forms an annular ram type shoulder 27 which engages against the outer or trailing edge of the blank 20 for providing an axial push upon the blank.

The punch includes a mandrel-like extension which passes through the interior of the blank and the die throat. The extension is formed in several sections, each of which is of a smaller diameter than the preceding section. Thus, the first extension section 28 is approximately of the same diameter as the inside diameter of the blank so that it closely fits within the blank and forms the finished I.D. of the thin wall section of the tube.

The next or middle or second extension section 29 is of a diameter that corresponds to the inside diameter of the thickened end portions 12 and 13 of the tube 10. The last or smallest extension section 30, that is, the third extension section, is of a diameter which corresponds to the I.D. of the ring-like formation 14 of the tube 10.

Figure 3:
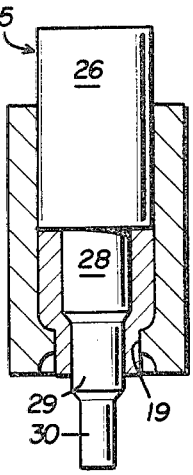

When the ram of the press is actuated, the punch moves axially of the die, as shown in FIG. 3, to position the second or middle extension 29 within the die throat. Thus, the slowly moving extension 29 creates an annular space relative to the die throat through which the lead portion of the blank is extruded. The lead portion is extruded in a wall thickness corresponding to the desired thickness of the tube enlarged end portion 12. The lead thickened end portion is designated as 12*a*, as shown in FIG. 4.

Figure 4:
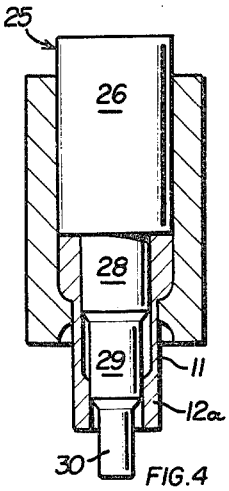

Continued movement of the punch, as illustrated in FIG. 4, results in the first extension section 28 moving into the die throat region so that further extrusion results in forming the thin wall 11 of the tube. During the extrusion, the extruded wall moves much more rapidly than does the die so that the overall tube length is considerably greater than the length of the die.

Figure 5:
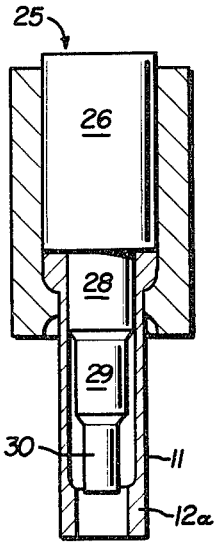

When the punch reaches the point where the thin wall section 11 is completely extruded, leaving an unextruded trailing end portion within the die, as shown in FIG. 5, the punch is stopped.

Figure 6:
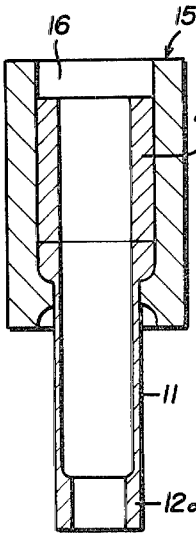
Figure 7:
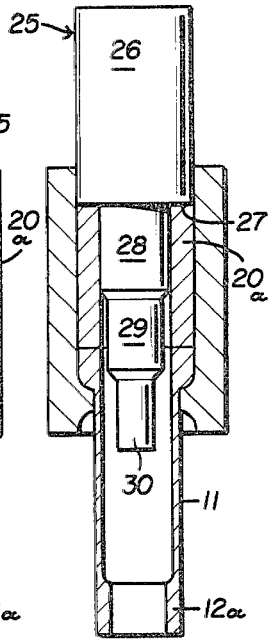

At this point, the punch 25 is removed from the die and a second blank 20*a* is inserted within the die as illustrated in FIG. 6. This second or new blank is arranged in end to end contact with the partially extruded blank beneath it. Then, the punch 25 is replaced or reinserted in the die as shown in FIG. 7. At that point, the ram forming annular shoulder 27 contacts the trailing end of the second blank. Thus, the second blank now acts like an extension of the ram shoulder 27, pushing against the trailing end of the partially extruded blank beneath it.

Figure 8:
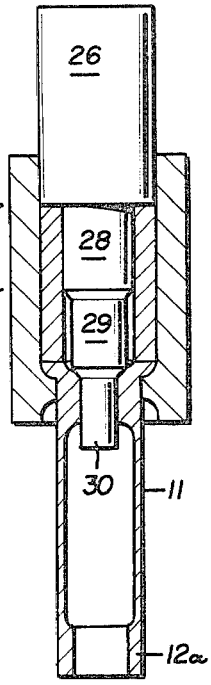

Because of the positioning of the second blank 20*a* within the die, the third or smallest extension section 30 of the punch is located within the die throat, as shown in FIG. 8. Thus, movement of the punch 25 results in the flow of material around the third extension section 30 which acts like a mandrel, to produce the inward enlarged ring-like formation 14.

Figure 9:
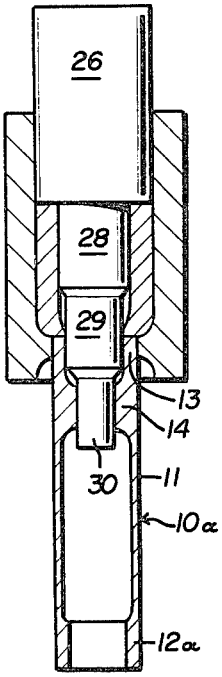

As the punch continues moving, as shown in FIG. 9, the second or middle extension section 29 enters into the die throat and at that point the material at the trailing end of the partially extruded blank fills the space between the section 29 and the die throat to form the thickened wall end portion 13. Meanwhile, as the portion 13 is being formed, the leading end of the second blank 20*a* is also extruded into the space between the section 29 and the die throat so that it simultaneously forms the thickened lead end 12*a* on the second blank.

Figure 10:
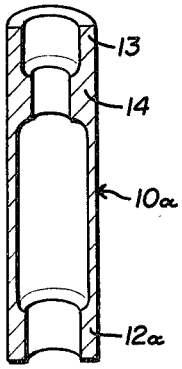
FIG. 10 is a cross-sectional, perspective, elevational view of the extruded or cold formed tube.

When the extruded tube 10*a*, illustrated in FIG. 9 and in FIG. 10, is completed, it is removed from the die. Thereafter, the die continues its movement to repeat the cycle, including at the appropriate time, inserting yet another blank. The cycle then proceeds over and over again to continuously produce extruded tubes 10*a*, as shown in FIG. 10.

Figure 11:
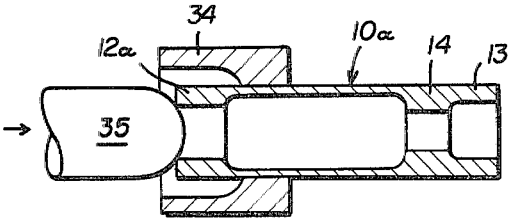
FIG. 11 illustrates the tube inserted within an end expansion die with an expander ram in position.
Figure 12:
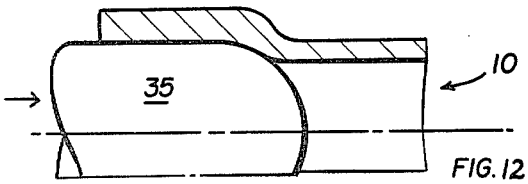
FIG. 12 is an enlarged, cross-sectional, fragmentary view showing the expanded tube end with the expander ram at the end of its stroke.

Once the tube 10*a* is completed, its lead end is inserted within an expander die 34, which is shown schematically in FIG. 11. A bullet-shaped expander ram 35 moves into the end of the tube to cold flow the thickened wall material outward, as schematically illustrated in FIG. 12. Thus, the previously inwardly thickened portion is now outwardly bowed and thickened to form the generally bell-shaped expanded end 12 of the finished axle 10 which is shown in FIG. 13. The expander ram produces a uniform diameter interior wall portion 36 within the expanded end portion 12. That uniform diameter inner wall can later be machined, if necessary, to receive bearings or other mounting inserts for supporting a shaft or the like.

The foregoing operation is preferably conducted cold, that is, at room temperature. With an appropriately sized press to provide the necessary press tonnage, when the blank which is cold is inserted within the tube, it may be coated with a lubricant, such as phosphate to facilitate its extrusion. However, it is at room temperature or cold. During the extrusion process, the temperature builds up within the metal due to the extrusion or metal flow so that it might reach as much as the area around 300 F. However, the temperature is well below the transition point for the metal so as not to effect the metallurgical structure due to heat.

The resultant axle tube is one-piece or integral in construction and is provided with thickened wall portions at the places desired. This integral one-piece construction has a good metallurgical structure for the purposes required. It also includes thinner wall sections than are generally obtainable by the typical forging or machining methods used in the past for these types of axles. Consequently, the completed part is considerably lighter in weight without sacrificing strength or thicker wall sections where actually needed.

Having fully described an operative embodiment of this invention, I now claim:

1. A process for extruding a metal tube with annular, thickened end portions at both of its ends, comprising the steps of:

positioning a relatively short, tubular blank within an open ended, tubular die having an inlet end through which the blank is inserted and an opposite extrusion end formed by an annular, inwardly extending, continuous shoulder forming a die extrusion throat through which the blank is extruded, and with the throat diameter being larger than the inner diameter of the blank;

inserting a punch into the die inlet end, with the punch closely fitted within the die and having an annular shoulder engaged against the free end of the blank and having a first punch extension closely fitted within the interior wall of the blank, and having a second punch extension of a smaller diameter than the blank interior diameter extended through part of the blank and die throat, and having a third punch extension, which is formed on the punch co-axial with and extending from the second punch extension, but of smaller diameter than the second punch extension, with the punch shoulder and punch extensions being located co-axially with each other and also with the blank and die throat, and with the second punch extension being located between the first and third punch extensions;

next, moving the punch towards the die throat so that the punch shoulder rams the blank towards the die throat, and simultaneously aligns its second punch extension with the die throat to thereby extrude the lead end of the blank through the annular space between said second punch extension and the die throat to thereby form one thickened end of the metal tube;

continuing moving the punch so that the first punch extension aligns with the die throat to thereby extrude the blank through the annular space between the first punch extension and the throat to form a relatively thin wall metal tube middle portion;

then removing the punch from the die, and inserting a second tubular blank within the die in full end to end contact with the trailing end of the partially extruded blank;

reinserting the punch in the die with its punch shoulder engaging the trailing end of the second blank, and with the punch first extension closely fitted within the second blank so that the punch second extension is aligned with but spaced from the die throat and the third punch extension is positioned within the die throat;

moving the punch in the direction of the die throat to extrude a portion of the first, partially extruded, blank through the annular space between the die throat and third punch extension to form a relatively thick ring adjacent the trailing end of the partially extruded blank, and thereafter proceeding with the step of moving the punch so that the second punch extension moves within the die throat and the second blank pushes the remainder of the first, partially extruded, blank through the annular space between the second punch extension and the die throat to form an inwardly thickened end portion on the trailing end of the first blank, and also, simultaneously extrudes an inwardly thickened end portion on the leading end of the second blank;

then removing the extruded first blank and continuing and repeating the cycle on the second and successive blanks;

expanding one of the thickened end portions of the tube, by pushing an expander ram into its end to flow the thickened end portion thereof outwardly, wherein the tube is of uniform O.D. except for its expanded end portion.

* * * * *